US007029368B2

(12) United States Patent
Bright et al.

(10) Patent No.: US 7,029,368 B2
(45) Date of Patent: Apr. 18, 2006

(54) APPARATUS FOR CONTROLLING WAFER TEMPERATURE IN CHEMICAL MECHANICAL POLISHING

(75) Inventors: Nicolas Bright, San Jose, CA (US); David J. Hemker, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/722,729

(22) Filed: Nov. 25, 2003

(65) Prior Publication Data

US 2004/0242124 A1 Dec. 2, 2004

Related U.S. Application Data

(63) Continuation of application No. 10/033,455, filed on Dec. 26, 2001, now Pat. No. 6,736,720.

(51) Int. Cl.
*B24B 1/00* (2006.01)

(52) U.S. Cl. ..... 451/7; 451/53; 451/60; 451/288

(58) Field of Classification Search ..... 451/7, 451/53, 60, 288
See application file for complete search history.

(56) References Cited

U.S. PATENT DOCUMENTS

| | | | | |
|---|---|---|---|---|
| 3,874,123 | A | 4/1975 | Hopkins et al. | |
| 4,197,676 | A | 4/1980 | Sauerland | |
| 4,600,469 | A | 7/1986 | Fusco et al. | |
| 4,793,895 | A | 12/1988 | Kaanta et al. | |
| 5,196,353 | A | 3/1993 | Sandhu et al. | |
| 5,240,552 | A | 8/1993 | Yu et al. | |
| 5,287,663 | A | 2/1994 | Pierce et al. | |
| 5,308,438 | A | 5/1994 | Cote et al. | |
| 5,337,015 | A | 8/1994 | Lustig et al. | |
| 5,413,941 | A | 5/1995 | Koos et al. | |
| 5,508,077 | A | 4/1996 | Chen et al. | |
| 5,597,442 | A | 1/1997 | Chen et al. | |
| 5,605,488 | A * | 2/1997 | Ohashi et al. | 451/7 |
| 5,643,050 | A | 7/1997 | Chen | |
| 5,647,952 | A | 7/1997 | Chen | |
| 5,873,769 | A | 2/1999 | Chiou et al. | |
| 5,882,244 | A | 3/1999 | Hiyama et al. | |
| 5,888,120 | A | 3/1999 | Doran | |
| 5,916,015 | A | 6/1999 | Natalicio | |
| 5,958,148 | A | 9/1999 | Holzapfel et al. | |
| 5,969,521 | A | 10/1999 | Kurita et al. | |
| 5,972,162 | A | 10/1999 | Cesna | |

(Continued)

FOREIGN PATENT DOCUMENTS

| | | |
|---|---|---|
| JP | 60201868 | 12/1985 |

(Continued)

*Primary Examiner*—George Nguyen
(74) *Attorney, Agent, or Firm*—Martine Penilla & Gencarella, LLP

(57) ABSTRACT

Apparatus controls the temperature of a wafer for chemical mechanical polishing operations. A wafer carrier wafer mounting surface positions a wafer adjacent to a thermal energy transfer unit for transferring energy relative to the wafer. A thermal energy detector oriented adjacent to the wafer mounting surface detects the temperature of the wafer. A controller is responsive to the detector for controlling the supply of thermal energy relative to the thermal energy transfer unit. Embodiments include defining separate areas of the wafer, providing separate sections of the thermal energy transfer unit for each separate area, and separately detecting the temperature of each separate area to separately control the supply of thermal energy relative to the thermal energy transfer unit associated with the separate area.

12 Claims, 9 Drawing Sheets

U.S. PATENT DOCUMENTS

| | | | |
|---|---|---|---|
| 5,985,094 | A | 11/1999 | Mosca |
| 5,993,302 | A | 11/1999 | Chen et al. |
| 6,012,964 | A | 1/2000 | Arai et al. |
| 6,030,488 | A | 2/2000 | Izumi et al. |
| 6,056,632 | A | 5/2000 | Mitchel et al. |
| 6,077,151 | A | 6/2000 | Black et al. |
| 6,106,662 | A | 8/2000 | Bibby, Jr. et al. |
| 6,110,012 | A | 8/2000 | Maury et al. |
| 6,110,026 | A | 8/2000 | Arai |
| 6,150,271 | A | 11/2000 | Easter et al. |
| 6,224,461 | B1 | 5/2001 | Boehm, Jr. et al. |
| 6,227,939 | B1 | 5/2001 | Monroe |
| 6,264,789 | B1 * | 7/2001 | Pandey et al. ..... 156/345.12 |
| 6,375,540 | B1 | 4/2002 | Mikhaylich et al. |
| 6,682,404 | B1 * | 1/2004 | Brunelli ..... 451/53 |
| 6,726,529 | B1 * | 4/2004 | Marcyk et al. ..... 451/7 |
| 2001/0046831 | A1 | 11/2001 | Wise et al. |

FOREIGN PATENT DOCUMENTS

| | | |
|---|---|---|
| JP | 60 201868 A | 5/1995 |
| JP | 09097829 | 8/1997 |
| JP | 2000343415 | 12/2000 |

* cited by examiner

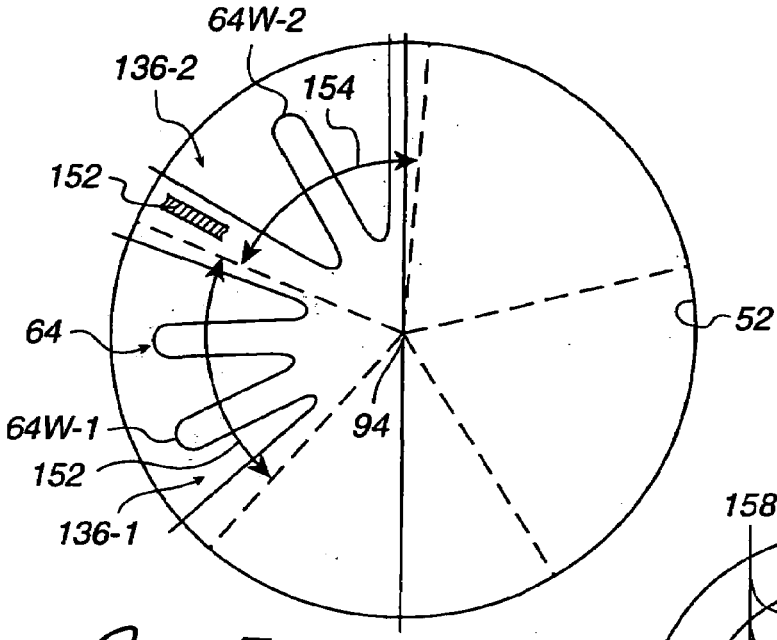
Fig. 7
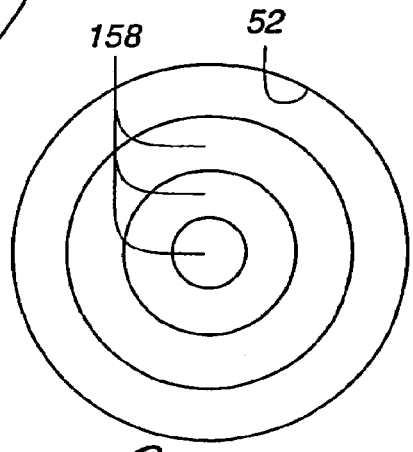
Fig. 8A
Fig. 8B
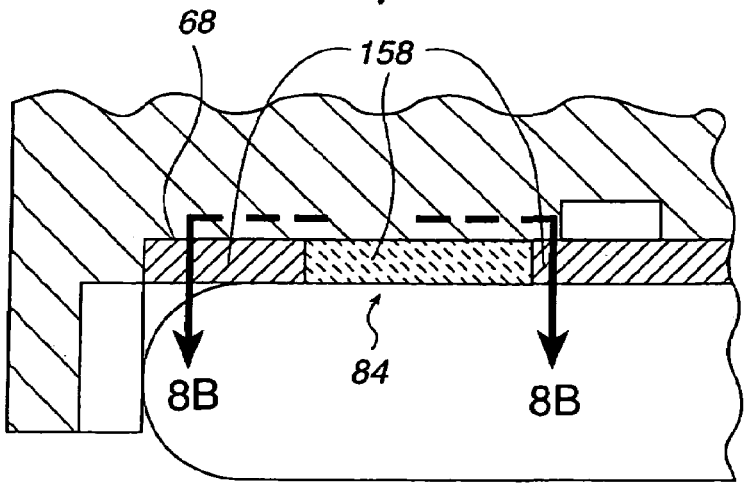

Fig. 9
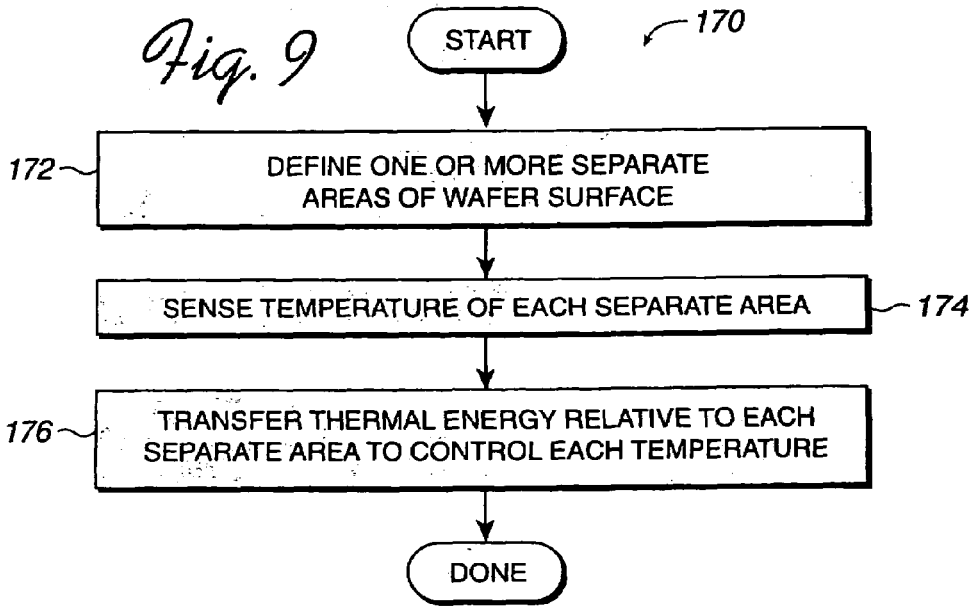
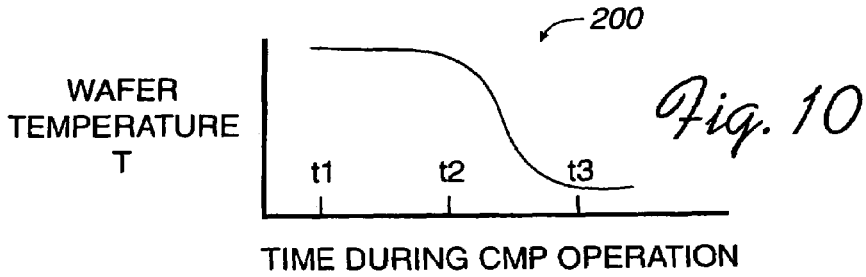
Fig. 10
Fig. 11
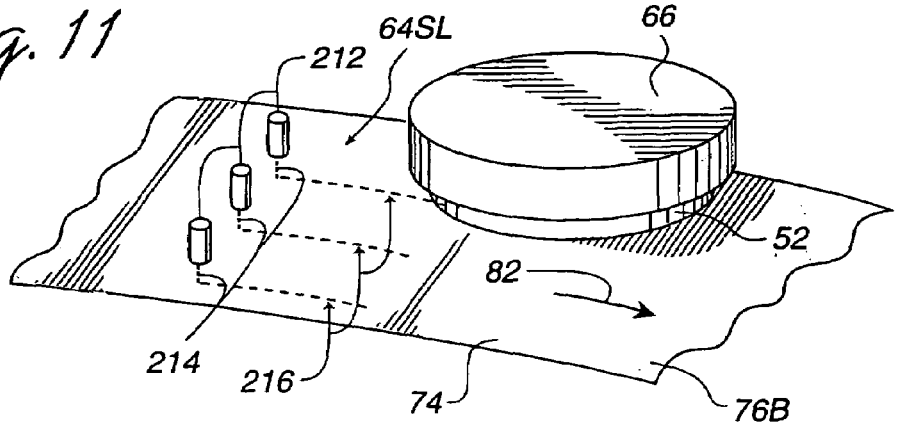

APPARATUS FOR CONTROLLING WAFER TEMPERATURE IN CHEMICAL MECHANICAL POLISHING

CROSS REFERENCE TO RELATED APPLICATION

The present application is a continuation claiming priority from application Ser. No. 10/033,455 under 35 U.S.C. § 120, filed Dec. 26, 2001, now U.S. Pat. No. 6,736,720 (the "parent application"), the disclosure of which parent application is incorporated by reference.

BACKGROUND OF THE INVENTION

1. Field of the Invention

The present invention relates generally to chemical mechanical polishing (CMP) systems, and to techniques for improving the performance and effectiveness of CMP operations. More specifically, the present invention relates to apparatus for controlling the temperature of a wafer by directly monitoring the wafer temperature and transferring thermal energy to or from the wafer during CMP operations.

2. Description of the Related Art

In the fabrication of semiconductor devices, there is a need to perform CMP operations, including polishing, buffing and wafer cleaning; and to perform wafer handling operations in conjunction with such CMP operations. For example, a typical semiconductor wafer may be made from silicon and, for example, may be a disk that is 200 mm or 300 mm in diameter. The 200 mm wafer may have a thickness of 0.028 inches, for example. For ease of description, the term "wafer" is used below to describe and include such semiconductor wafers and other planar structures, or substrates, that are used to support electrical or electronic circuits.

Typically, integrated circuit devices are in the form of multi-level structures fabricated on such wafers. At the wafer level, transistor devices having diffusion regions are formed. In subsequent levels, interconnect metallization lines are patterned and electrically connected to the transistor devices to define the desired functional device. Patterned conductive layers are insulated from other conductive layers by dielectric materials. As more metallization levels and associated dielectric layers are formed, the need to planarize the dielectric material increases. Without planarization, fabrication of additional metallization layers becomes substantially more difficult due to the higher variations in the surface topography. In other applications, metallization line patterns are formed in the dielectric material, and then metal CMP operations are performed to remove excess metallization.

In a typical CMP system, a wafer is mounted on a carrier with a surface of the wafer exposed for CMP processing. The carrier and the wafer rotate in a direction of rotation. The CMP process may be achieved, for example, when the exposed surface of the rotating wafer and an exposed surface of a polishing pad are urged toward each other by a force, and when such exposed surfaces move in respective polishing directions. Chemical aspects of the CMP process include reactions between the wafer and the components of slurry which is applied to the polishing pad and to the wafer. Mechanical aspects of the CMP process include the force by which the wafer and the polishing pad are urged toward each other, and the relative orientations of the wafer and the polishing pad.

Although control has been provided for many of the factors on which successful CMP processing depends, a CMP system typically does not directly control the temperature of the wafer. For example, factors such as the angle of the exposed surface of the wafer relative to the exposed surface of the polishing pad may be controlled by gimbals. In other types of CMP systems, linear bearings are provided to avoid having any such angle.

Such control of factors other than wafer temperature only indirectly influences the wafer temperature during CMP operations. For example, temperature-dependent chemical reactions have been indirectly influenced by controlling the force by which the wafer and carrier head are urged toward each other, which may affect frictional heating and indirectly cause temperature changes in the wafer. Attempts have also been made to overcome anticipated problems caused by uneven polishing of the exposed surface of the wafer. Such attempts provide contours on the polishing pad (e.g., a polishing belt). Further, various materials have been provided between the wafer carrier and the wafer to allow fluids to flow from the carrier head to the wafer. For example, in vacuum heads that carry the wafer, a thin film has been provided to distribute the slurry from the head to the wafer. However, although fluids such as slurry have temperature-dependent characteristics, such as viscosity, the typical CMP system does not directly control the temperature of the wafer.

This situation relating to indirect control, or no control, of wafer temperature is complicated by the interrelationship of many of the factors that are controlled, and the combined effect of such factors on CMP operations. Thus, for example, if wafer-to-carrier force is increased in an attempt to increase wafer temperature, many other unintended variables may be influenced, and limit or prohibit the use of such force for the intended temperature control. For example, such force may directly affect the rate of polishing in a manner that conflicts with the need to have a particular wafer temperature.

What is needed then, is a CMP system for directly controlling the temperature of a wafer during CMP operations, which does not rely on indirect factors such as CMP force, for example. Such a CMP system would provide apparatus that directly monitors the temperature of the wafer during the CMP operations, and controls one or more sources of thermal energy so that the desired wafer temperature is achieved. Moreover, since the desired CMP operations may require temperature variations across the area of the wafer, such a CMP system would be provided in which apparatus directly monitors the temperature of the various areas of the wafer during the CMP operations, and separately controls the sources of thermal energy so that the desired wafer temperature is achieved for each of the wafer areas. Additionally, such a CMP system would configure structure that is in direct contact with the wafer during CMP operations, so that the configuration is consistent with the desired wafer temperature control.

SUMMARY OF THE INVENTION

Broadly speaking, the present invention fills these needs providing CMP systems which implement solutions to the above-described problems. Thus, by the present invention, a CMP system may control local planarization properties on the wafer during the performance of one or more CMP operations on the wafer. The properties may, for example, be the amount of material removed from the wafer. Via a system controller and a thermal controller, operations are performed for controlling the temperature of the wafer so as to achieve desired local planarization properties on the wafer. For such purpose, such system may directly control the temperature of a wafer during CMP operations, without relying on indirect factors such as CMP force, for example. Such a CMP system further provides apparatus that directly monitors the temperature of the wafer during the CMP operations, and controls one or more sources of thermal energy so that the desired wafer temperature is achieved. Moreover, to accommodate CMP operations requiring temperature variations across the area of the wafer, such a CMP system may be configured to directly monitor the temperature of the various areas of the wafer during the CMP operations, and separately controls the sources of thermal energy so that the desired wafer temperature is achieved for each of the wafer areas. Additionally, such a CMP system may configure structure that is in direct contact with the wafer during CMP operations, such as a wafer support film, so that the configuration (e.g., thermal transfer characteristic) is consistent with the desired wafer temperature control.

In the present invention, one aspect of controlling the temperature of a wafer for chemical mechanical polishing operations provides a wafer carrier having a wafer mounting surface. A thermal energy transfer unit may be adjacent to the wafer mounting surface for transferring energy relative to the wafer. A thermal energy detector may be adjacent to the wafer mounting surface for detecting the temperature of the wafer. A controller is responsive to the detector for controlling the supply of thermal energy to the thermal energy transfer unit.

In another aspect of the present invention, apparatus is provided for monitoring and controlling the temperature of a wafer for chemical mechanical polishing operations. A thermal energy transfer unit is configured with separate spaced sections, each section being adjacent to a separate area of the wafer mounting surface. Also, each separate section is effective to transfer a separate amount of energy relative to a particular area of the wafer. A controller may be responsive to each of many detectors associated with the separate areas for controlling the supply of thermal energy to the separate spaced sections of the thermal energy transfer unit.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, wherein like reference numerals designate like structural elements.

FIG. 7 is a partial schematic view looking downward onto another embodiment of the multiple heated-cooled ring-type configuration of the thermal energy transfer unit, and many arrays of temperature sensors associated with the ring-type configuration;

FIG. 8A is a partial, enlarged view of a portion of the structure shown in FIG. 2, showing a carrier film positioned on a wafer mounting surface of the carrier head, wherein the carrier film is thermally configured with a coefficient of thermal conductivity that varies with respect to the positions of different areas of the film;

FIG. 8B is a plan view of the carrier film shown in FIG. 8A, illustrating the different areas of the carrier film;

FIG. 9 is a flow chart illustrating operations of a method of monitoring the temperature of a wafer during chemical mechanical polishing operations;

FIG. 10 is a graph depicting control of the wafer temperature with respect to time during CMP operations; and FIG. 11 is a schematic view of separate temperature-controlled slurry supplies dropping separate temperature-controlled slurry flows onto a polishing belt.

DETAILED DESCRIPTION OF THE PREFERRED EMBODIMENTS

An invention is described for a CMP system which implements solutions to the above-described problems. Thus, by the present invention, a CMP system controls the temperature of a wafer during CMP operations, without relying on indirect factors such as CMP force, for example. Such a CMP system further provides apparatus that directly monitors the temperature of the wafer during the CMP operations, and controls one or more sources of thermal energy so that the desired wafer temperature is achieved. In this manner, for CMP operations requiring temperature variations across the area of the wafer, for example, such a CMP system may be configured to directly monitor the temperature of individual ones of various areas of the wafer during the CMP operations, and to separately control the sources of thermal energy so that the desired wafer temperature is achieved for each of the individual wafer areas.

In the following description, numerous specific details are set forth in order to provide a thorough understanding of the present invention. It will be understood, however, to one skilled in the art, that the present invention may be practiced without some or all of these details. In other instances, well known process operations and structure have not been described in detail in order not to obscure the present invention.

Figure 1A:
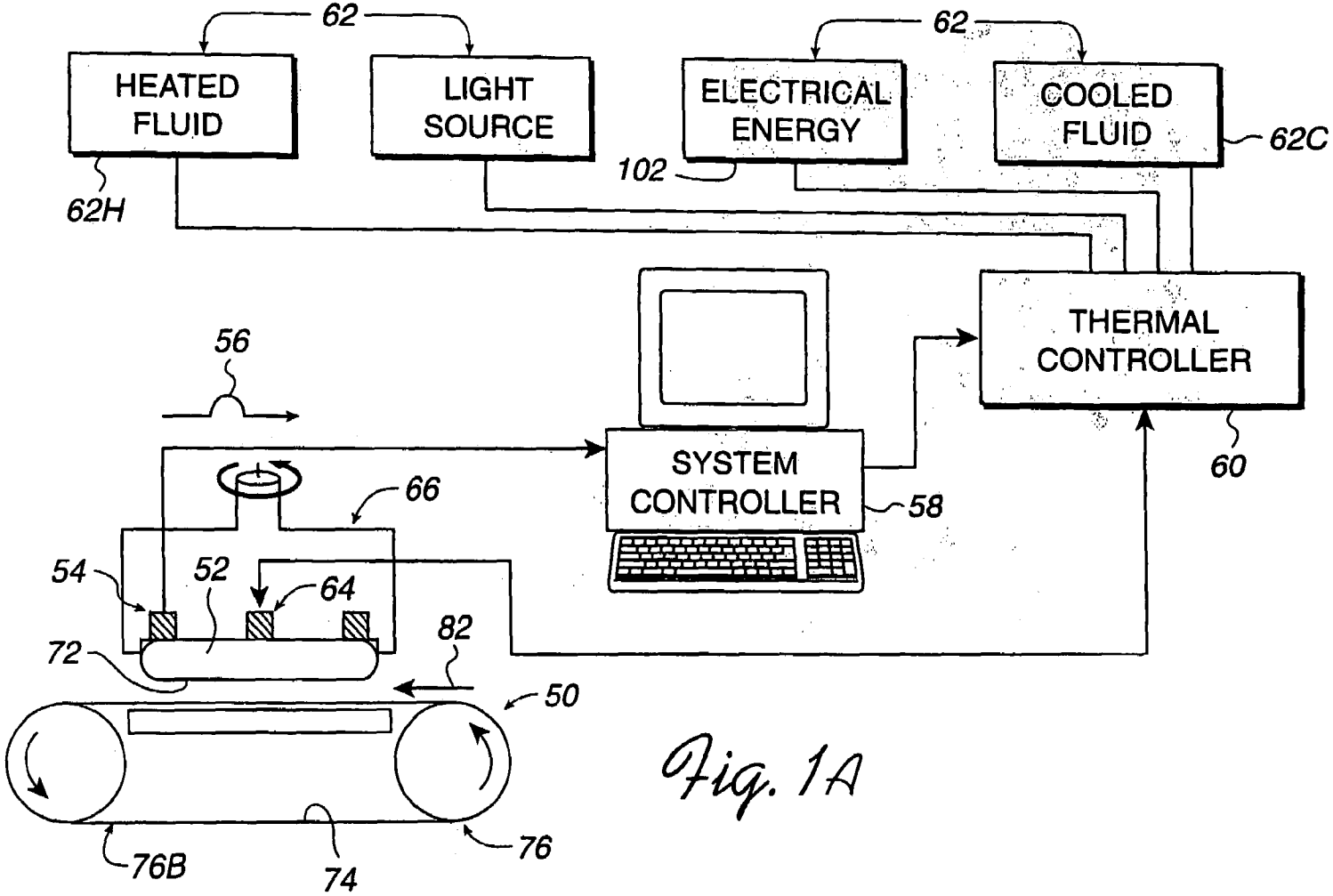
FIG. 1A is a schematic diagram of a system of the present invention for controlling the temperature of a wafer, showing a controller of thermal energy used to provide energy transfer relative to the wafer mounted on one type of CMP system.

Referring to FIG. 1A, the present invention may be understood as providing a CMP system 50 for controlling the temperature T of a wafer 52 during CMP operations, without relying on indirect factors such as CMP force, for example. A thermal energy detector 54 directly monitors the temperature T of the wafer 52, and outputs one or more temperature signals 56 to a system controller 58. The system controller 58 controls a thermal controller 60 that implements the connection of one or more sources 62 of thermal energy to one or more thermal energy transfer units 64. The units 64 are mounted on a carrier head 66 and operate under the control of the thermal controller 60 and the system controller 58 so that the desired wafer temperature T of the wafer 52 is achieved.

In general, the system 50 may perform a method of controlling local planarization properties on the wafer 52 during the performance of one or more CMP operations on the wafer 52. The properties may, for example, be the amount of material removed from the wafer 52. Via the system controller 58 and the thermal controller 60, operation are performed for controlling the temperature of the wafer 52 so as to achieve desired local planarization properties on the wafer 52, as more fully described below.

Figure 1B:
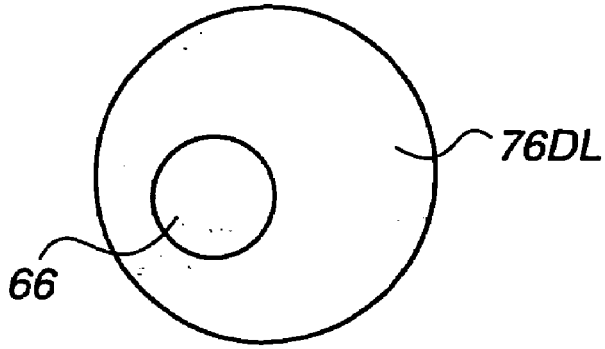
FIG. 1B is a schematic diagram of a system of the present invention for controlling the temperature of a wafer, showing the wafer mounted on another type of CMP system.
Figure 1C:
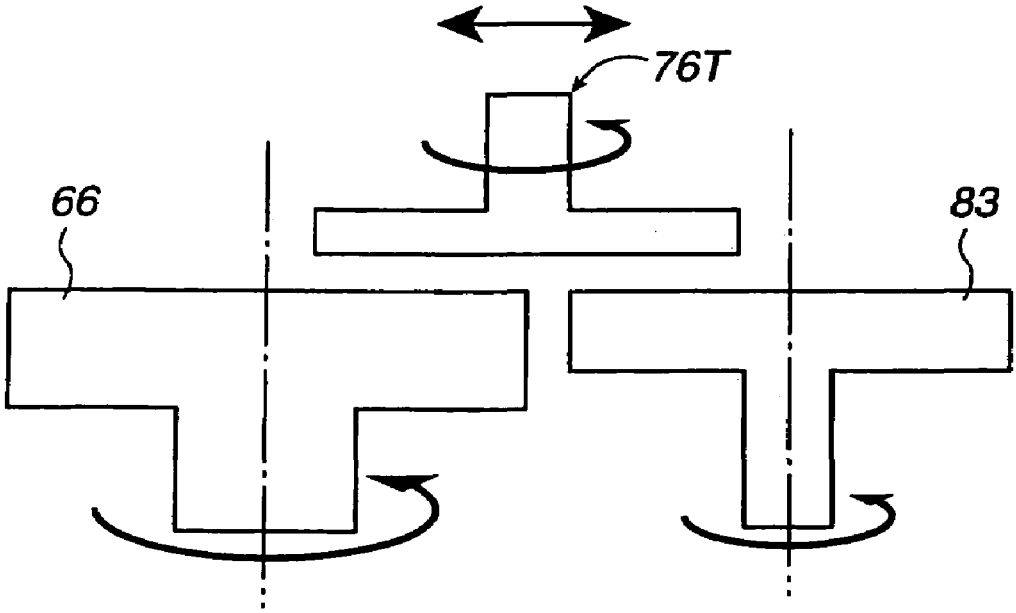
FIG. 1C is a schematic diagram of a system of the present invention for controlling the temperature of a wafer, showing the wafer mounted on yet another type of CMP system.

The carrier head 66 may be any type of head providing a mounting surface 68 for mounting the wafer 52 with an exposed surface 72 in position to be urged against a polishing surface 74 of a polishing pad 76. FIG. 1A shows an exemplary carrier head 66 for use with a belt-type polishing pad 76B that moves in the direction of arrows 82 to perform the CMP operations. However, other type of heads 66 and pads 76 may be used. For example, FIG. 1B looks down on the carrier head 66 having the same (wafer down) orientation as in FIG. 1A. The carrier head 66 is shown used with a disk-like polishing pad 76DL having a substantially larger diameter than that of the wafer 52 and the carrier 66. In FIG. 1C, the carrier head 66 is shown in a wafer up orientation adjacent to a disk-like polishing pad conditioner 83. Here, a traversing and rotating disk-like polishing pad 76T is moved over part of the area of the wafer 52 for subaperture CMP operations, and is also moved over the pad conditioner 83.

Figure 2:
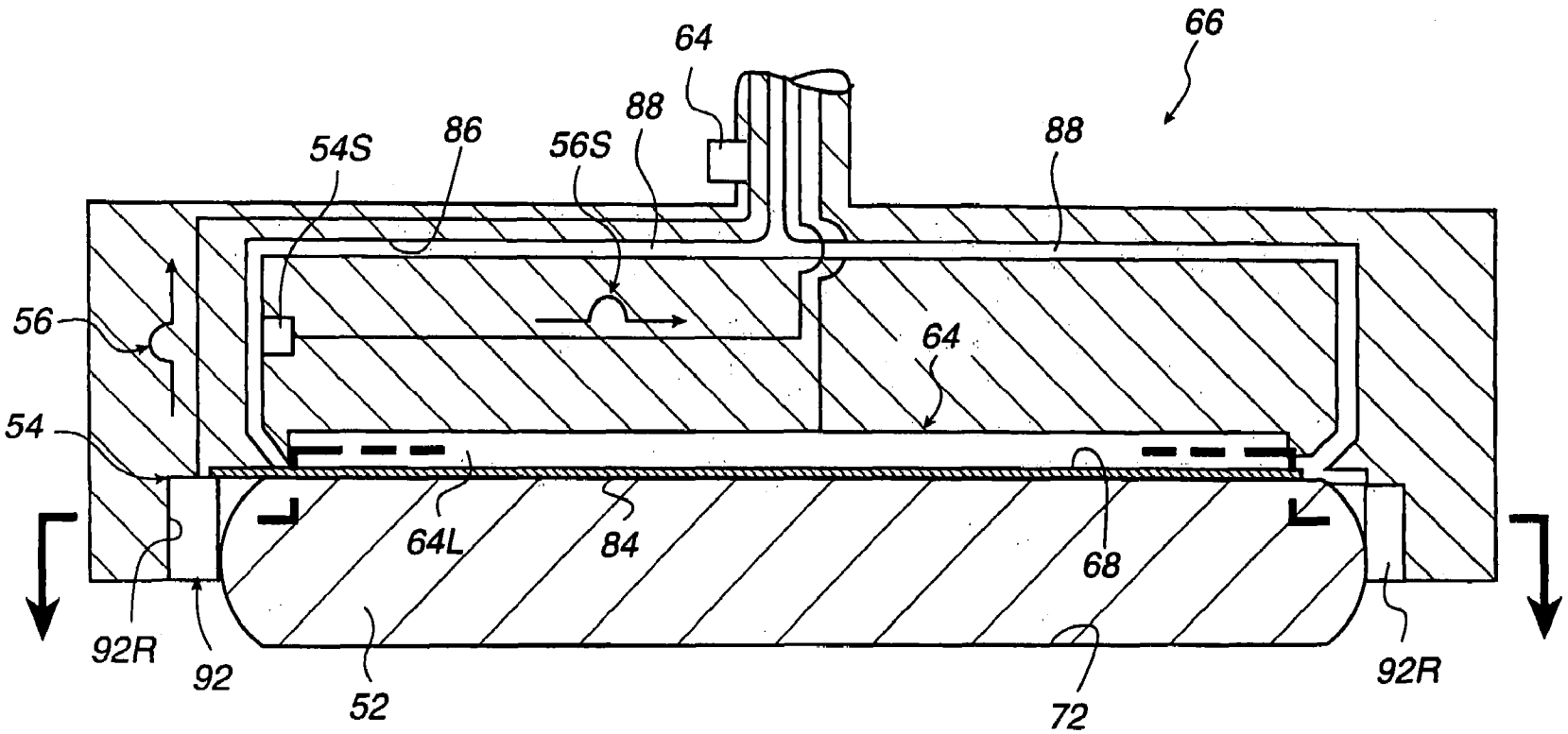
FIG. 2 is a schematic diagram of a carrier head of the present invention illustrating a light source embodiment of a unit for transferring thermal energy relative to an entire area of a wafer on the head, and a ring-shaped embodiment temperature sensor.

FIG. 2 depicts an embodiment of the carrier head 66 of the present invention that is provided with the thermal energy transfer unit 64 in the form of a light source 64L for transferring thermal energy relative to the wafer 52. In the case of the light source 64L, the thermal energy transfer relative to the wafer 52 may be transfer to the wafer 52 mounted on the carrier head 66. The light source 64L may be any source configured for distributing high intensity light energy uniformly over a wide area, e.g., uniformly across the entire area of the wafer 52. Such light energy may include radiant or conductive energy to provide the thermal transfer to the wafer 52. Generally, such a light source 64L rapidly transfers such thermal energy. The light source 64L is shown adjacent to the wafer 52, which may be mounted on a carrier film 84. The light source 64L may be a tungsten halogen lamp, for example. The light source 64L for supplying the thermal energy uniformly across the entire wafer area is an example of one embodiment of the present invention. It is to be understood that the description below relates to other embodiments of the present invention for supplying the thermal energy non-uniformly across the entire wafer area.

Regardless of the particular type of unit 64 that is provided on the carrier head 66, the carrier head 66 may be provided with one or more passageways 86 through which slurry 88 is supplied for distribution through the carrier film 84 and between the opposed contacting surfaces 72 and 74 (FIG. 1A) of the wafer 52 and the pad 76, respectively. Depending on the type of the polishing pad used, slurry 88 composed of an aqueous solution containing different types of dispersed abrasive particles such as $SiO_2$ and/or $Al_2O_3$ may be applied to the polishing pad 76, thereby creating an abrasive chemical solution between the polishing pad 76 and the exposed surface 72 of the wafer 52. Since the temperature of the slurry 88 is one influence on the temperature T of the wafer 52, and the viscosity of the slurry 88 may be temperature dependent, a thermal energy detector 54S may be mounted adjacent to the passageways 86 to directly monitor the temperature of the slurry 88, and to output a temperature signal 56S to the system controller 58. In a manner similar to the use of the signals 56, the system controller 58 uses the signal 56S in determining how to control the thermal controller 60 so that the desired temperature T of the wafer 52 is achieved. In one aspect of the present invention, the temperature of the slurry 88 may be used to control the temperature T of the wafer 52. For example, as shown in FIG. 2, thermal energy transfer units 64 may also be mounted on the carrier head 66 in thermal energy transfer relationship with the slurry passageways 86 and operated under the control of the thermal controller 60 and the system controller 58 so that a desired temperature of the slurry 88 is achieved. Via contact of the slurry 88 and the wafer 52, the desired wafer temperature T of the wafer 52 may be achieved independently of the thermal energy transfer units 64L shown in FIG. 2, for example.

FIG. 2 also depicts the carrier head 66 provided with the thermal energy detector 54 in the form of a thermocouple 92 for directly monitoring the temperature T of the wafer 52. The thermocouple 92 may be configured as a ring 92R surrounding the wafer 52 for sensing the average temperature T of the wafer 52 adjacent to the exposed surface 72. The thermocouple 92 may output the temperature signal 56 to the system controller 58. In situations in which the detector 54 need not be close to or touching the wafer 52 in order to accurately detect the temperature T of the wafer 52, the detector 54 may be mounted in the carrier head 66 slightly spaced from the wafer 52. Such detector 54 may thus detect the temperature of the carrier head 66 adjacent to (very close to) the wafer 52 and thereby provide an accurate indication of the wafer temperature (e.g., a temperature within five degrees of the actual wafer temperature T). The light source 64L for supplying the thermal energy uniformly across the entire wafer area is an example of one embodiment of the present invention.

Figure 3A:
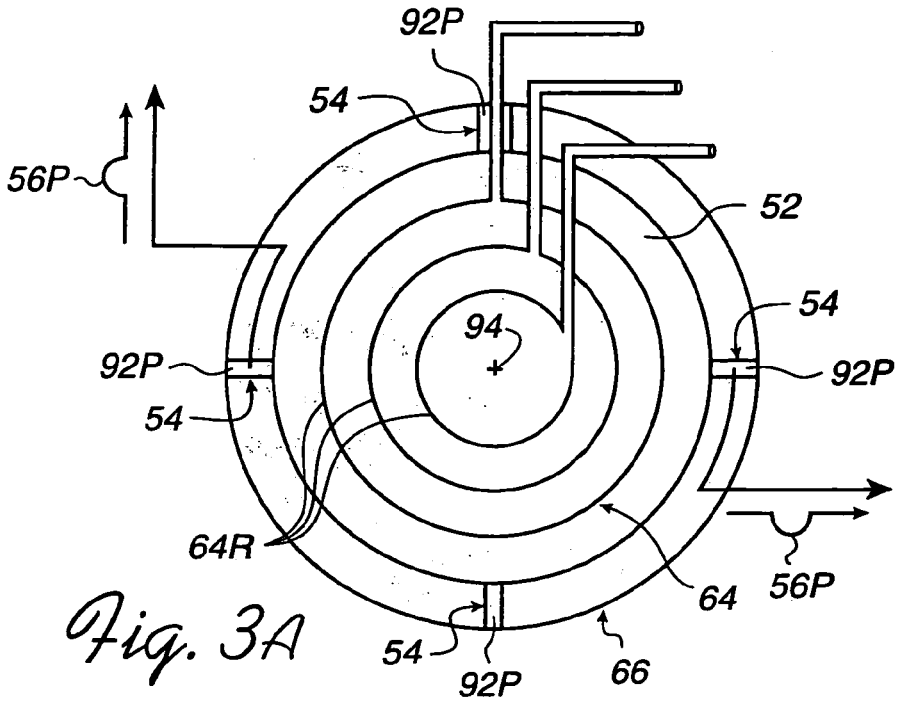
FIG. 3A is a schematic view looking downward onto a concentric ring configuration of one embodiment of the thermal energy transfer unit, and a probe embodiment of a temperature sensor.

Another embodiment of the present invention also transfers thermal energy uniformly relative to the entire wafer area. FIG. 3A shows the thermal energy transfer unit 64 in the form of a series of concentric rings that define resistance heaters 64R. As in the case of the light source 64L, the transfer of thermal energy by the resistance heaters 64R is transfer to the wafer 52 mounted on the carrier head 66. The heaters 64R are configured as separate concentric rings and are shown as three rings for distributing thermal energy uniformly over the entire area of the wafer 52. For wafers 52 having a large diameter (e.g., 300 mm wafers as compared to 200 mm wafers) more rings may be used to assure uniform heating and thus uniform temperature T over the entire area of the wafer 52. Such thermal energy from the resistance heaters 64R is in the form of conductive energy to provide the thermal transfer to the wafer 52. The resistance heaters 62R may be mounted adjacent to the wafer 52, which may also be mounted on the carrier film 84. Each resistance heater 64R may be a Watlow resistance heater, for example.

FIG. 3A also depicts the carrier head 66 provided with another embodiment of the thermal energy detector 54. Here, many short thermocouple probes 92P are evenly spaced around the wafer 52 for directly monitoring the temperature T of the wafer 52 at locations adjacent to the exposed surface 72. A signal 56P from each of the probes 92P may be individually monitored by the system controller 58 to determine the wafer temperature T at the location of the particular probe 92P, or the signals 56P may be averaged by the system controller 58 for determining the average temperature T of the wafer 52 adjacent to the exposed surface 72. To provide assurance that the temperature T is uniform across the area of the exposed surface 72 of the wafer 52, the system controller 58 may compare the sensed temperatures T from the respective probes 92P. A zero, or small (e.g., five degrees C.), difference in these temperatures T may be used to indicate a uniform temperature T across the area of the wafer 52. Although four probes 92P are shown in FIG. 3A, more or fewer probes 92P may be provided based on factors such as the diameter, for example, of the wafer 52. Also, to provide further assurance that there is a uniform temperature T across the area of the wafer 52, an array of separate thermal energy detectors 54 may be used as more fully described below with respect to FIG. 5A, for example.

Figure 3B:
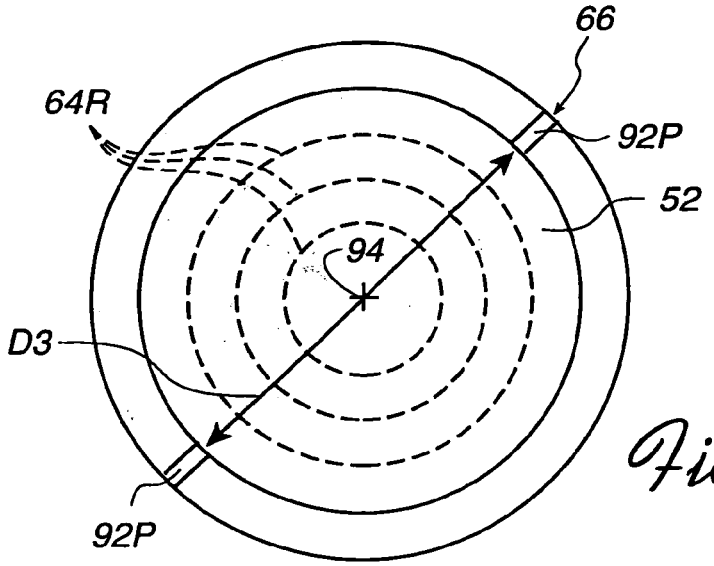
FIG. 3B is a schematic diagram showing a diameter extending across concentric areas of the wafer.
Figure 3C:
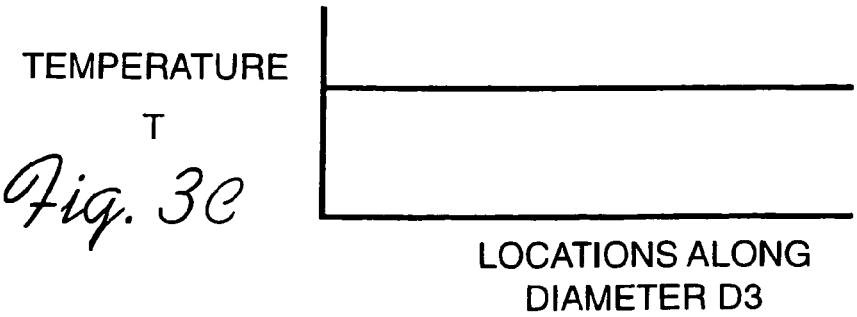
FIG. 3C is a graph showing a uniform temperature vs. diameter position characteristic of the thermal energy transfer unit shown in FIG. 3A.

FIG. 3B depicts a plan view looking up to the exposed surface 72 of the wafer 52 mounted on the carrier head 66. The exemplary three rings 64R are shown in dashed lines, and a diameter D3 is shown extending from one edge of the wafer 52 across a center 94 of the wafer 52 and outwardly to the opposite edge. The diameter D3 may extend between the probes 92P on opposite sides of the wafer 52, for example. The uniform temperature T across the area of the exposed surface 72, as desired in this embodiment of the present invention, is illustrated in terms of the graph of FIG. 3C, which shows locations along the diameter D3 plotted against the temperature T of the wafer 52. The temperature T is shown as being relatively constant, indicating that there is no temperature gradient across the area of the exposed surface 72 of the wafer 52.

Figure 4A:
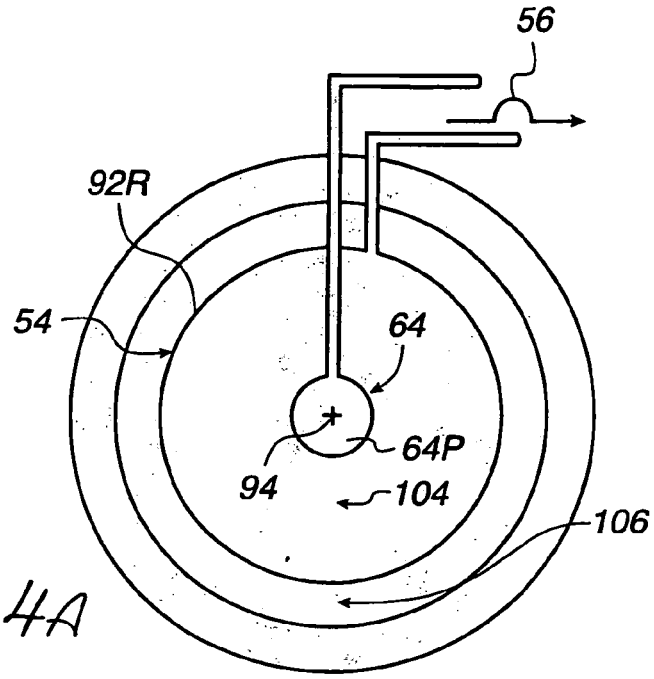
FIG. 4A is a schematic view looking downward onto a central point embodiment of the thermal energy transfer unit, and a ring-shaped embodiment of a temperature sensor.

Other embodiments of the present invention are provided for supplying the thermal energy non-uniformly across the entire wafer area, and are shown in FIGS. 4A–7. That is, each such embodiment may provide a thermal gradient across the exposed surface 72 of the wafer 52. FIG. 4A shows a first of these embodiments, illustrating the thermal energy transfer unit 64 in the form of one central disk 64P which may be located at a point on, such as the center 94 of, the wafer 52. The disk 64P may be configured from piezoelectric material which responds to electrical energy from a source 102 (FIG. 1A) and generates thermal energy. The transfer of thermal energy by the disk 64P is transfer to the wafer 52 mounted on the carrier head 66. As the only controllable source of thermal energy to the wafer 52, the disk 64P may distribute thermal energy into the center 94 of the wafer 52. The thermal energy is thus non-uniformly transferred to the wafer 52. The thermal energy from the disk 64P will flow outwardly, or radially, from the center 94 toward the edges of the wafer 52. The temperature T of exemplary areas 104 and 106 away from the center 94 is less than that at the center 94, such that the lowest value of the temperature T is adjacent to the edge of the wafer 52 in this embodiment. The disk 64P may be mounted adjacent to the wafer 52 in a manner similar to that shown in FIG. 2 with respect to the light source 64L.

FIG. 4A also depicts the carrier head 66 provided with an embodiment of the thermal energy detector 54, which may be similar to the thermocouple 92 shown in FIG. 2, including a thermocouple ring 92R. Or for example, many short thermocouple probes 92P may be provided as described above with respect to FIG. 3A. The thermocouple ring 92R surrounds the wafer 52 for sensing the average temperature T of the wafer 52 adjacent to the exposed surface 72. The thermocouple ring 92R may output the temperature signal 56 to the system controller 58.

Figure 4B:
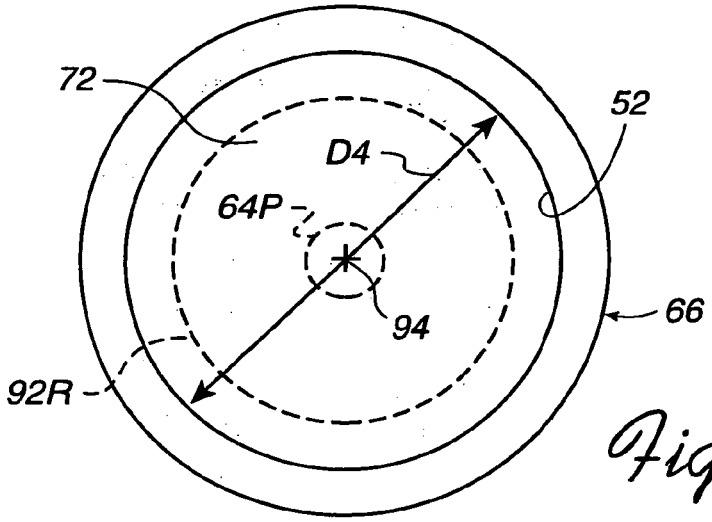
FIG. 4B is a schematic diagram showing a diameter extending across an area of the wafer between the central point and the ring-shaped sensor.
Figure 4C:
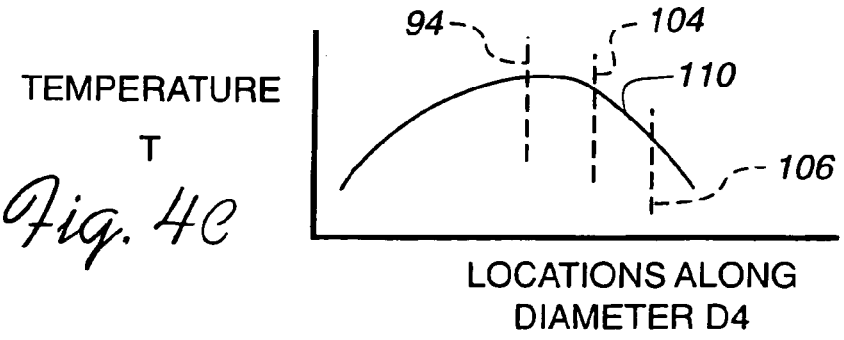
FIG. 4C is a graph showing an embodiment of a thermal gradient, a variable temperature vs. diameter position characteristic of the thermal energy transfer unit shown in FIG. 4A.

FIG. 4B depicts a plan view looking up to the exposed surface 72 of the wafer 52 mounted on the carrier head 66. The exemplary central disk 64P is shown in dashed lines, and the diameter D4 is shown extending from one edge of the wafer 52 across the center 94 of the wafer 52 and outwardly to the opposite edge. The diameter D4 may extend between opposite sides of the ring 92R on opposite sides of the wafer 52, for example. The temperature gradient across the area of the exposed surface 72, as desired in this embodiment of the present invention, is illustrated in terms of the graph of FIG. 4C, which shows locations along the diameter D4 plotted against the temperature T of the wafer 52. The signal 56 from the ring 92R indicates such temperature T at the ends of the diameter D4. FIG. 4C shows an inverted U-shaped curve 110 depicting an exemplary desired temperature gradient across the area of the exposed surface 72 of the wafer 52. The curve 110 indicates that the temperature T has a greatest value at the center 94 and decreases outwardly.

If it is preferred to more precisely measure the temperatures T at locations along a diameter D4 of the wafer 52, and thus measure the temperature gradient resulting from the use of the central disc 64P, an array of separate thermal energy detectors 54A may be used as more fully described below with respect to FIG. 5A. Using such an array, in actual CMP operations, the shape of the curve 110 may tend to vary from the inverted U-shape shown in FIG. 4C, based for example, on the heat transfer characteristics of the CMP process, or of the carrier film 84 as more fully described below with respect to FIG. 8. Notwithstanding such tendency, it may be desired to have the thermal gradient vary in a specific manner, for example, according to the curve 110 shown in FIG. 4C. To offset such non-uniform heat transfer characteristic of the CMP process at one area (e.g., 106), the thermal energy transfer unit 64 may be configured as described with respect to FIGS. 6A and 7, for example.

Figure 5A:
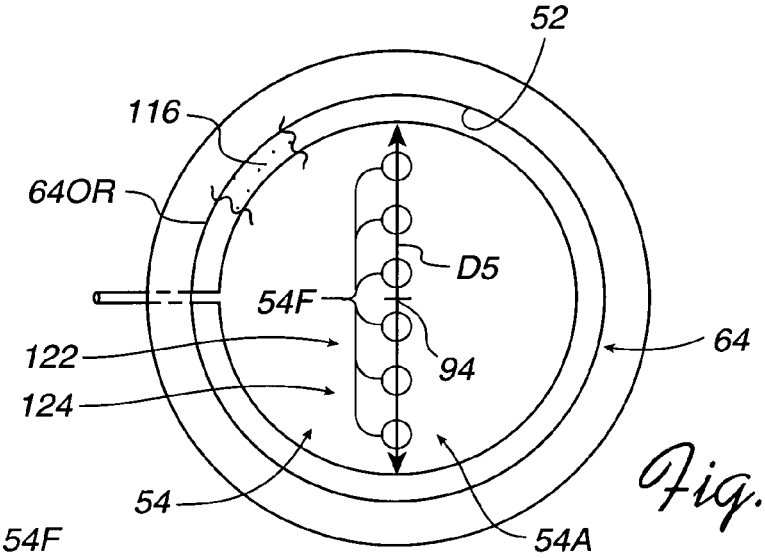
FIG. 5A is a schematic view looking downward onto an outer ring-shaped fluid supply configuration of another embodiment of the thermal energy transfer unit, and an array of temperature sensors.

Another of the embodiments in which a thermal gradient is provided across the exposed surface 72 of the wafer 52 is shown in FIG. 5A, which illustrates the thermal energy transfer unit 64 in the form of one outer ring 64OR. The outer ring 64OR may be configured with a circular shape extending adjacent to the edge of the wafer 52. The ring 64OR may be a resistance heater similar to the ring 64R shown in FIG. 3A, or may be made from the piezoelectric material of the disk 64P shown in FIG. 4A. However, for transferring thermal energy relative to the wafer 52 both as thermal energy to the wafer 52 and from the wafer 52, the embodiment shown in FIG. 5A provides an ability to supply thermal energy transfer fluid 116 to the outer ring 64OR both at a low temperature TL and at a high temperature TH. For this purpose the outer ring 64OR is configured as a hollow ring-shaped pipe. The ring 64OR may be mounted adjacent to the wafer 52 in a manner similar to that shown in FIG. 2 with respect to the light source 64L. The fluid 116 may be ethylene glycol, for example.

One of the sources 62 may be provided to both heat and cool the fluid 116 in response to the thermal controller 60, or as shown in FIG. 1A, one source 62H may supply heated fluid 116 and another source 62C may supply cool fluid 116. The thermal controller 60 operates under the control of the system controller 58 to connect either the source 62H or the source 62C to the ring 64OR, as may be appropriate for heating or cooling. The controller 60 supplies the fluid 116 having the appropriate temperature to the hollow ring 64OR. As the only controllable source, or receiver, of thermal energy to or from the wafer 52, the ring 64OR may transfer thermal energy directly to, or from only the outer edge of, the wafer 52. The thermal energy is thus non-uniformly transferred to or from the area of the wafer 52. In heating, the thermal energy transferred directly from the ring 64OR to the wafer 52 will flow inwardly, or radially, from the edge toward the center 94 of the wafer 52. There is a change of the temperature T of areas 122 and 124 away from the edge, for example. For cooling, the thermal energy transferred to the ring 64OR directly from the wafer 52 flows outwardly, or radially, from the center 94 to the edge of the wafer 52, and thus to the ring 64OR. There is a change of the temperature T of areas 122 and 124 away from the edge. As appropriate to whether the fluid is supplied to the wafer 52 cooler than the current temperature T of the wafer 52, or is supplied to the wafer 52 warmer than the current temperature T of the wafer 52, the lowest value of the temperature T will be adjacent to the edge of the wafer 52 in this embodiment, or will be adjacent to the center 94, respectively.

Figure 5D:
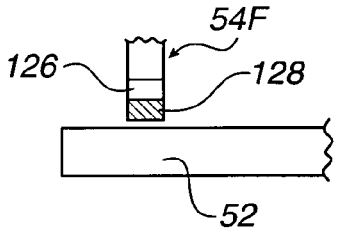
FIG. 5D is a view of a typical one of the sensors having a detector tip provided with a coating.

FIG. 5A depicts the carrier head 66 provided with an embodiment of the thermal energy detector 54 configured to sense the temperature T of the wafer 52 at each of many spaced locations. As further described below, the temperature gradient may be oriented in various ways relative to the center 94 of the wafer 52 or with respect to the edge of the wafer 52. For monitoring a temperature gradient across the diameter D5, for example, the detector 54 is configured with an array 54A of separate thermal energy sensors 54F arranged along the diameter D5 in uniformly spaced relationship. The array 54A crosses the areas 122 and 124, for example. FIG. 5D shows a typical one of the sensors 54F as a fluoroptic probe (such as a LUXTRON brand probe) having a detector tip 126 provided with a coating 128 of a material that fluoresces differently in response to different temperatures. The tip 126 may be located adjacent to the wafer 52, as by being in direct contact with the wafer 52. In a configuration of the carrier head 66 in which the carrier film 84 is used (e.g., see FIG. 2), the tip 126 may be immediately adjacent to the carrier film 84 which contacts the wafer 52. The intensity of the signal 56 from the fluoroptic probe 54F provides an indication of the temperature T at the location of the probe 54F. Due to the uniform spacing of the probes 54F of the array, when the system controller 58 receives the signals 56 from the various probes 54F, for each probe 54F there is both an indication of the temperature T, and a reference to the location of the probe 54F (e.g., along the diameter D5). Via a relationship between a particular one of the signals 56 and the location of the probe 54F that generated the particular signal 56, the system controller 58 thus receives an indication of the actual thermal gradient across the diameter D5 of the wafer 52, may compare the actual thermal gradient to the desired thermal gradient, and then cause the appropriate thermal transfer to occur via the ring 64OR of the thermal energy transfer unit 64.

Figure 5B:
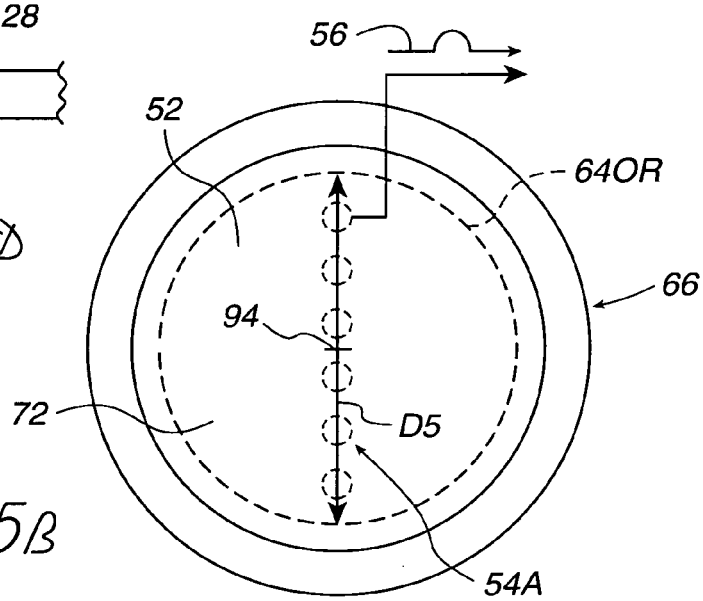
FIG. 5B is a schematic diagram showing a diameter extending across an area of the wafer along the array of sensors between opposite sides of the ring-shaped fluid supply configuration.
Figure 5C:
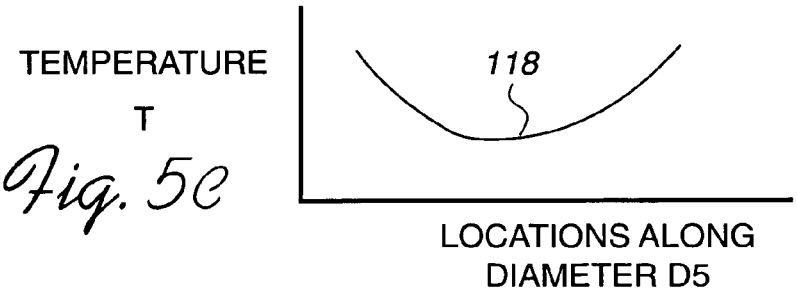
FIG. 5C is a graph showing another thermal gradient, another temperature vs. diameter position characteristic of the thermal energy transfer unit shown in FIG. 5A.

FIG. 5B depicts a plan view looking up to the exposed surface 72 of the wafer 52 mounted on the carrier head 66. The exemplary ring 64OR is shown in dashed lines, and the diameter D5 is shown extending from one edge of the wafer 52 across the center 94 of the wafer 52 and outwardly to the opposite edge. The diameter D5 may thus generally extend between opposite sides of the ring 64OR, for example, and along the array 54A. The temperature gradient across the area of the exposed surface 72, as desired in this embodiment of the present invention, is illustrated in terms of the graph of FIG. 5C, which shows locations along the diameter D5 plotted against the temperature T of the wafer 52. FIG. 5C shows a generally U-shaped curve 118 depicting the temperature gradient across the diameter D5 of the exposed surface 72 of the wafer 52. The curve 118 indicates that the temperature T has a greatest value at the edges and decreases inwardly. If the characteristics of the CMP process (e.g., whether the process is exothermic or endothermic) are such that the desired thermal gradient may be achieved by either supplying cooled fluid 116 or heated fluid 116 to the ring 64OR, then as described above the system controller 58 may cause the thermally appropriate (hot or cold) fluid 116 to be supplied to the outer ring 64OR from the appropriate source 62H or 62C.

Similar to that described above with respect to FIGS. 4A–4C, in actual practice, the shape of the curve 118 may tend to vary from the U-shape shown in FIG. 5C. The variation may be based for example, on the heat transfer characteristics of the CMP process, or of the carrier film 84 as more fully described below with respect to FIGS. 8A and 8B, for example. Notwithstanding such tendency, it may be desired to have the thermal gradient vary in a specific manner, for example, according to the curve 118 shown in FIG. 5C. To offset such non-uniform heat transfer characteristic of the CMP process at one area (e.g., 122), the thermal energy transfer unit 64 may be configured as described below with respect to FIG. 6A, for example.

Figure 6A:
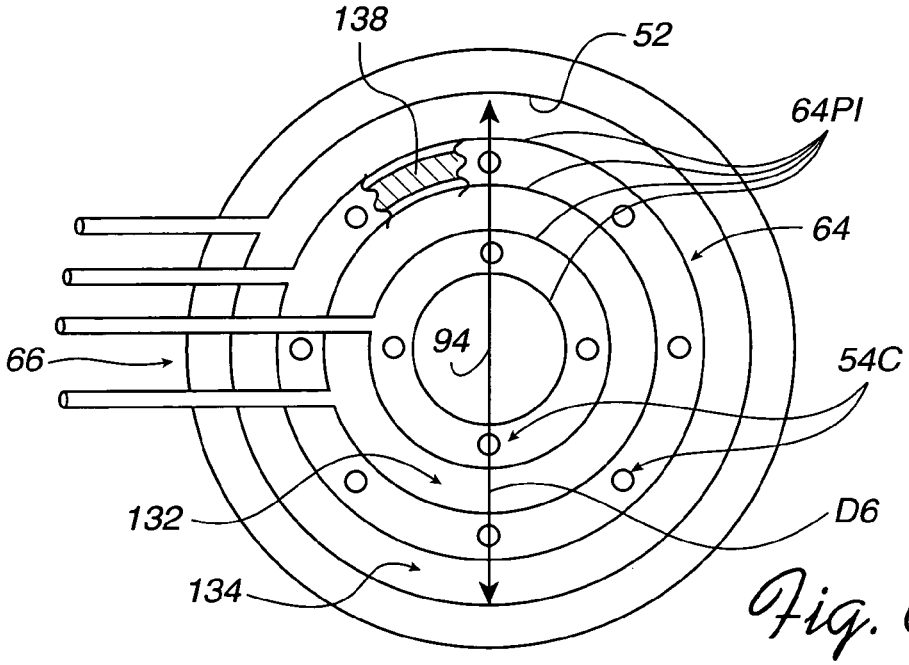
FIG. 6A is a schematic view looking downward onto a multiple heated-cooled ring type configuration of another embodiment of the thermal energy transfer unit, and many arrays of temperature sensors.

Referring the FIG. 6A, the present invention also fills the need to have the thermal gradient vary in a specific manner across the diameter D of the wafer 52. Also accommodated is an offset for a non-uniform heat generation or transfer characteristic of the CMP process at one area (e.g., 132) as compared to another area 134, for example. FIG. 6A depicts another embodiment of the present invention in which different thermal energy transfer may take place separately at two or more different areas of the wafer 52 at the same time. These exemplary areas may be the radially spaced areas 132 and 134, for example. Also, the areas may be the pie-, or wedge-, shaped areas 136 shown in FIG. 7. Considering FIG. 6A, for example, the one thermal energy transfer may be to the area 132 and another thermal energy transfer may be from the area 134, or the reverse. For example, at a given time the CMP process may create thermal energy at area 134 (such that an undesired rise in the temperature T would result without the temperature control of the present invention), and at the same time the CMP process may absorb thermal energy at area 132 (such that an undesired decrease in the temperature T would result without the temperature control of the present invention). The separate transfers of thermal energy may be provided from the area 134 and to the area 132 under the control of the system controller 58.

FIG. 6A shows the thermal energy transfer unit 64 in the form of many hollow rings, or pipes, 64PI. Each pipe 64PI may be configured with a circular shape extending arcuately over a separate annular area of the wafer 52, e.g., over one of the areas 132 or 134. An outer pipe 64PI may be adjacent to the edge of the wafer 52, and a next inner pipe 64PI may be radially inward from the outer pipe 64PI to provide separate thermal transfer to or from many annular areas of the wafer 52.

The pipes 64PI may be configured for transferring thermal energy relative to the wafer 52 both as thermal energy to the wafer 52 and from the wafer 52. For this purpose, the pipes 64PI may be hollow optical fibers capable of guiding light from the source 62L for thermal energy supply. The pipe 64PI may also be connected to the source 62C of the cooled fluid 116 to provide thermal energy transfer away from the particular area of the wafer 52.

The embodiment shown in FIG. 6A provides thermal energy transfer with respect to each of the many pipes 64PI in a manner similar to the outer ring 64OR shown in FIG. 5A, i.e., both at a low temperature TL and at a high temperature TH adjacent to the wafer 52. Thus, one of the sources 62 may be provided to both heat and cool the fluid 116 in response to the thermal controller 60, or as shown in FIG. 1A, one source 62H may supply heated fluid 116 and another source 62C supply cool fluid 116. The thermal controller 60 operates under the control of the system controller 58 to connect either the source 62H or the source 62C to each of the pipes 64PI. The controller 60 supplies the fluid 116 having the appropriate temperature to the appropriate pipe 64PI. The pipes 64PI may be mounted on the carrier head 66 adjacent to the wafer 52, as described above with respect to the ring 64OR. Each pipe 64PI transfers thermal energy directly and primarily to or from one particular area (e.g., 132 or 134) of the wafer 52. The thermal energy may thus be non-uniformly transferred relative to the entire area of the wafer 52. The thermal energy transferred directly from or to a particular area 132 or 134, for example, will either increase or decrease the temperature T of that area. By providing thermal insulation 138 between the individual pipes 64PI, such change in temperature T of that area 132 will be substantially independent from any change of the temperature T of any adjacent area 134 of the wafer 52.

Figure 6B:
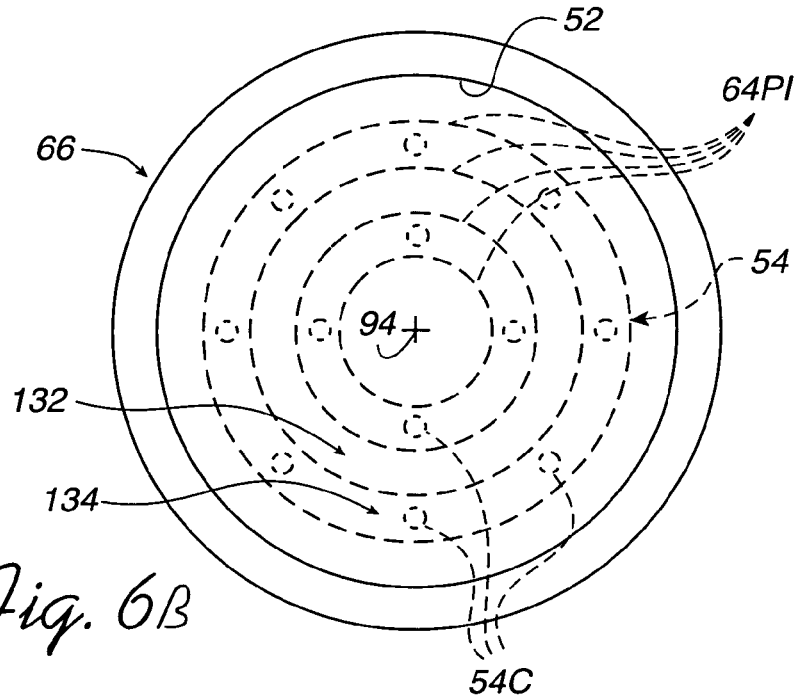
FIG. 6B is a schematic diagram showing annular areas of the wafer and one of the arrays of sensors aligned with each array.

FIG. 6A also depicts the carrier head 66 provided with an embodiment of the thermal energy detector 54 configured to sense the temperature T of the wafer 52 at each of many spaced locations. Such locations correspond to the areas served by the various pipes 64PI. As further described below, a desired temperature gradient may be oriented in various ways, such as from the center 94 to the edge of the wafer 52, for example. FIG. 6B depicts a plan view looking up to the exposed surface 72 of the wafer 52 mounted on the carrier head 66. Exemplary circular pipes 64PI are shown in dashed lines, and the annular areas 132 and 134 are shown within the dashed lines for simplicity of illustration. For a temperature gradient that varies across the diameter D6 (FIG. 6A), for example, and in which substantially the same temperature T is desired within each the annular areas (e.g., 132) concentric with the center, the detector 54 may be configured with concentric circular arrays 54C of the separate thermal energy sensors 54F that are described above with respect to FIG. 5A. One array 54C is arranged in an annular path around the area 132 to facilitate monitoring the temperature T of the area 132. For each array 54C, the detectors 54F are positioned in a uniformly spaced relationship around the annular area 132, for example. Each array 54C is thus spaced from an adjacent array 54C. Due to the uniform spacing of the probes 54F of an individual array 54C, and due to the separation of one array 54C from the other arrays 54C, when the system controller 58 receives the signals 56 from the various probes 54F, for each probe 54F there is both an indication of the temperature T, and a reference to the array 64C of which the probe 54F is a part, and of the location of the probe 54F. The system controller 58 thus receives data by which to provide an indication of the actual thermal gradient around the particular annular area (e.g., 132) of the wafer 52, and may compare such actual thermal gradient to the desired thermal gradient for that area. Similarly, the system controller 58 may use the signals 56 from various probes 54F arranged along the diameter D6 in FIG. 6A to determine whether a thermal gradient along the diameter D6 is acceptable, or should be changed by appropriate control of the temperature of the fluid supplied to the pipes 64PI, for example.

Figure 6C:
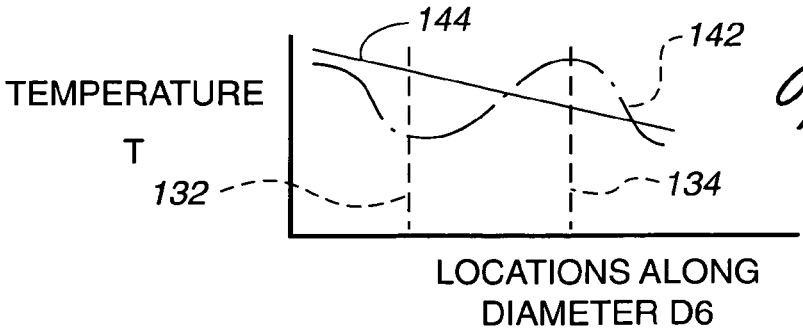
FIG. 6C is a graph showing two thermal gradients, one which may result from CMP operations without the present invention, and another using the temperature control of the present invention.

The temperature gradient across the area of the exposed surface 72, as desired in this embodiment of the present invention, is illustrated in terms of the graph of FIG. 6C, which shows locations along the diameter D6 plotted against temperature T of the wafer 52. The locations correspond to the locations of different ones of the probes 54F adjacent to the annular area 132, 134, etc. An undulating curve 142 depicts an exemplary temperature gradient across the diameter D6 of the exposed surface 72 of the wafer 52. The curve 142 represents the temperature gradient without the temperature monitoring and control of the present invention, which gradient may be based on the CMP process creating thermal energy at the area 134 (such that an undesired rise in the temperature T results without the temperature control of the present invention), and at the same time the CMP process absorbing thermal energy at area 132 (such that an undesired decrease in the temperature T results without the temperature control of the present invention). FIG. 6C also shows a uniform curve 144 depicting an exemplary controlled temperature gradient across the diameter D6 of the exposed surface 72 of the wafer 52. The curve 144 represents the temperature gradient with the temperature monitoring and control of the present invention. Despite the CMP process creating thermal energy at the area 134, in response to the signal 56 from the detector 54F adjacent to the area 134, the pipe 64PI for the area 134 is controlled to transfer thermal energy from that area 134 and reduces the temperature T as shown in curve 144 at location 134. In this manner, the system 50 avoids the undesired rise in the temperature T which would result at the area 134 without the temperature control of the present invention. Similarly, by providing thermal energy to the area 132 the system 50 avoids the undesired decrease in the temperature T that would result at the area 132 without the temperature control of the present invention.

It may be understood then that in this manner the system 50 may be used to control the variation across the diameter D6 of the wafer 52 of the thermal gradient in a specific manner, including control to eliminate the thermal gradient. The system 50 may provide such control whether an undesired possible thermal gradient is based on a non-uniform heat generation or thermal energy transfer characteristic of the CMP process at one area (e.g., 132) as compared to another area 134, for example.

Another embodiment of the system 50 enables the area of the wafer 52 to be divided into shapes other than the annular shapes of the areas 132 and 134, for example. FIG. 7 shows a portion of the wafer 52 having the exemplary wedge-, or pie-, shaped areas 136. The temperature T of these pie-shaped areas 136 may be controlled, for example, by configuring the thermal energy transfer unit 64 in the form of many hollow rings, or pipes, 64W. The wafer 52 is cut away in FIG. 7 to show that each pipe 64W may be in a wedge-shaped configuration adjacent to a separate one of the wedge-shaped areas 136 of the wafer 52. A first pipe 64W-1 may be adjacent to a first area 136-1 as defined by a selected angle 152 of the total area of the wafer 52. A second pipe 64W-2 may be adjacent to a second area 136-2 as defined by a selected angle 154 and be located adjacent to the first pipe 64W-1. Insulation 152 may be provided between the areas 136 to thermally separate such areas 136. Based on the embodiments described above, other wedge-shaped pipes 64W, or other thermal transfer units 64 may be provided for the other portions of the area of the wafer 52. Similarly, based on the embodiments described above, detectors may be suitably arranged relative to the wedge-shaped areas 136 for separately monitoring and controlling the temperature T of each such area 136 the wafer 52.

FIGS. 8A and 8B depict a further embodiment of the system 50 in which the thermal transfer characteristics of the carrier film 84 may be used in combination with the monitoring and control of the temperature T of the wafer 52. The film 84 is shown having many sections 158, which may be configured in any shape, including the annular-shaped areas shown in FIG. 8B, for example. The sections 158 may be provided with different thermal transfer characteristics, such as surface roughness or coefficient of thermal conductivity, for example. In this manner, in view of a particular thermal characteristic of the CMP process (e.g., exothermic reaction) at a particular location, the film 84 may be configured to allow more thermal energy transfer to or less thermal energy transfer from, the wafer 52 adjacent to that particular location. The different thermal energy transfer characteristics may also be provided to thermally separate one of the separate portions of the thermal energy transfer unit 64 from another one of the separate portions of the thermal energy transfer unit 64.

As described above, the system 50 may perform a method of controlling local planarization properties on the wafer 52 during the performance of one or more CMP operations on the wafer 52. One aspect of such method involves monitoring the temperature of the wafer 52. FIG. 9 depicts a flow chart 170 describing operations of a method of the present invention for monitoring the temperature of a wafer 52 during chemical mechanical polishing operations. The method may include an operation 172 of defining at least one separate area of a surface of the wafer 52. A particular temperature T is to be maintained on the at least the one separate area during the chemical mechanical polishing operation. The area may be the entire area of the wafer 52, or one of the above-described areas 132, 134, or 136, for example. The method moves to an operation 174 of sensing the temperature of the at least one separate area during the chemical mechanical polishing operation. The sensing may be performed using one of the detectors 54 described above.

Another aspect of the method may be to perform operation 172 to define the at least one separate area as many of the separate areas across the surface of the wafer 52, such as the many areas 136, or 132 and 134, for example. The separate areas may be concentric with the center 94 of the wafer 52, and a particular temperature T may be maintained on each of the plurality of concentric separate areas. Also, the sensing operation 174 may be performed by separately sensing the temperature of each of such separate areas. The method may move to an operation 176 for transferring thermal energy relative to the at least one area, or to each of the separate areas, according to the sensed temperature of the respective areas and a comparison of the sensed temperature to a desired temperature of that area.

It may be understood that the comparison of the sensed temperature to a desired temperature of that area may be performed by the system controller 58. The system controller 58 may be a Watlow temperature controller, or computer, that is programmed to process the received signals 56. For example, when there is one signal 56 on the carrier head 66, the one signal may be compared to stored data that represents a desired value of the temperature T of the wafer 52. Based on any difference resulting from the comparison, the system controller 58 will cause the thermal controller 60 to provide thermal energy to the carrier head 66 to bring the sensed temperature T to the desired value. The stored data may be entered into the system controller 58 after having determined that one value, for example, of the desired temperature will result in providing a desired local planarization property on the wafer, such as a desired amount of removal of portions of the wafer 52 by CMP.

There may be many signals 56, as when there is the uniform spacing of the probes 54F of an individual array 54C as described above, for example. As described, due to the separation of one array 54C from the other arrays 54C, the system controller 58 may receive the signal 56 from one of the probes 54F as data indicating the temperature T, the array 54C corresponding to that probe 54F, and the location of the probe 54F. The system controller 58 is programmed to organize such data and provide an indication (e.g., the graphs of FIGS. 5C and 6C) of the actual thermal gradient around the particular annular area (e.g., 132) of the wafer 52. Such data for the actual thermal gradient around the particular annular area of the wafer 52 (e.g., curve 142) is compared to data representing the desired thermal gradient for that area (e.g., curve 144). The system controller 58 then causes the thermal controller 60 to operate to provide the desired temperatures T at the various areas. As described above, this may be done, for example, by connecting either the source 62H or the source 62C to the ring 64OR, as may be appropriate for heating or cooling. The system controller 58 controls the controller 60 to supply the fluid 116 having the appropriate temperature to the hollow ring 64OR. Thus, despite the exemplary situation in which the CMP process creates thermal energy at the area 134, in response to the signal 56 from the detector 54F adjacent to the area 134, the programming of the system controller 58 may cause the pipe 64PI for the area 134 to transfer thermal energy from that area 134 and reduce the temperature T as shown in curve 144 at location 134.

When the array 54C is used, for example, the stored data is entered into the system controller 58 after having determined that many individual values, for example, of the desired temperature T will result in providing individual desired local planarization properties at respective areas (e.g., areas 132 and 134, FIG. 6B) on the wafer 52. Such determination may, for example, be based on the temperature-dependent chemical reactions between the slurry 88 and the wafer 52. Generally, for example, the higher the temperature of the slurry 88 that is in contact with the wafer 52, and the higher the temperature T of the wafer 52, the faster the rate of removal, i.e., the faster the CMP operation will take place.

Another aspect of the present invention relates to the temperature v. time graph shown in FIG. 10, in which the wafer temperature T is shown at a high value at a time t1. The time t1 may correspond to the start of a particular CMP operation, and generally a fast rate of polishing, or removal, is desired and provided by the high value. However, with increased time (e.g., from time t1 to time t2) during which the CMP operation is performed, greater control may be required over the rate of removal. For this purpose, the wafer temperature T is shown being decreased to a low value starting at time t2, and continuing to time t3, for example. The times t2 and t3 may be closer to the end of a particular CMP operation, and generally a low, or slow, rate of polishing is then desired so as to avoid over-polishing of the wafer 52. Based on the above description, the system 50 may be used at the times t1, t2, and t3, for example, to provide such temporally-related control of the wafer temperature T.

Yet another aspect of the present invention relates to the contact between the wafer 52 and the polishing pad 76. Such contact is under pressure, such that there may be thermal energy transfer between the wafer 52 and the pad 76. The system 50 may be used as described above to control the temperature of the pad 76 by controlling the temperature T of the wafer 52. In this manner, when the polishing characteristics of the pad 76 (e.g., rate of polishing at a given pressure) vary with respect to the temperature of the pad 76, the wafer temperature T may be controlled, and by the wafer-pad contact the temperature of the pad 76, and thus the polishing characteristics of the pad 76, may be selected at any time during the CMP operations.

A further aspect of the present invention relates to the use of the temperature of the slurry 88 to control the temperature T of the wafer 52. For example, as shown in FIG. 11, thermal energy transfer units 64SL may be configured as separate outlets 212 mounted over the polishing pad 76B. The separate outlets 212 supply separate flows 214 of the slurry 88 onto separate sections 216 of the pad 76B, which sections 216 move with the pad 76B to the carrier head 66. The temperatures of the sections 216 of the pad 76B are determined by the temperature of the slurry 88 in the respective flows 214. The pad movement brings the respective sections 216 of slurry 88 into thermal energy transfer relationship with separate respective areas of the wafer 52, so that a desired temperature of each respective area of the wafer 52 may be achieved, for example. The sections 216 of the pad 76B with the respective temperature slurry 88, and the resulting temperatures T of the respective areas of the wafer 52, may be used to provide a desired local planarization property on each area of the wafer, such as a desired amount of removal of each area of the wafer 52.

It may be understood that the present invention fills the above described needs by providing the CMP system 50 and the described methods which implement solutions to the above-described problems. Thus, by the CMP system 50 and those methods direct control is maintained over the temperature T of the wafer 54 during the CMP operations. That is, such temperature T is controlled without relying on indirect factors such as CMP force, for example, applied to the wafer 52. Such a CMP system 50 further directly monitors the temperature T of the wafer 52 during the CMP operations. Moreover, to accommodate CMP operations requiring temperature variations across the area of the wafer, such a CMP system 50 is configured to directly monitor the temperature T of the various areas (e.g., 132, 134, 136) of the wafer 52 during the CMP operations, and to separately control the sources 62 of thermal energy so that the desired wafer temperature T is achieved for each of the wafer areas. Additionally, such a CMP system 50 and methods configure structure that is in direct contact with the wafer during CMP operations, such as the wafer support film 84 mounted on the carrier head 66, so that the film configuration (e.g., thermal transfer characteristic) is consistent with the desired wafer temperature control.

Although the foregoing invention has been described in some detail for purposes of clarity of understanding, it will be apparent that certain changes and modifications may be practiced within the scope of the appended claims. For example, the areas of the wafer 52 may be defined with various sizes and shapes according to where thermal energy transfer is to be controlled. Also, the configurations of the thermal energy transfer units 64 and of the detectors 54 may be varied corresponding to those defined areas. Accordingly, the present embodiments are to be considered as illustrative and not restrictive, and the invention is not to be limited to the details given herein, but may be modified within the scope and equivalents of the appended claims.

What is claimed is:

1. Apparatus for changing the temperature of a wafer for chemical mechanical polishing operations, the apparatus comprising:

a wafer carrier having a surface for supporting a back surface of the wafer;

a thermal energy transfer unit configured with a plurality of sections positioned at separate spaced locations defined by one given diameter of the wafer, each separate section being effective to transfer a separate amount of energy relative to one of the respective separate spaced locations; and a thermal energy detector comprising a plurality of separate detectors spaced along the one given diameter of the wafer, the separate detectors being configured so that one of the separate detectors corresponds to each separate spaced location of the thermal energy transfer unit for detecting the temperatures at each separate spaced location.

2. An apparatus as recited in claim 1, further comprising:

a controller responsive to each of the separate detectors for controlling a transfer of thermal energy relative to each respective separate spaced section of the thermal energy transfer unit, the controller being connected to respective ones of the separate detectors corresponding to each of the separate locations for controlling a transfer of thermal energy relative to each of the separate spaced locations of the thermal energy transfer unit to control a thermal gradient across the diameter of the wafer.

3. An apparatus as recited in claim 1, wherein the diameter along which the thermal energy detectors are spaced intersects each of the separate spaced sections, and wherein each detector that is spaced along the diameter is configured to output a signal representing the temperature of the corresponding separate spaced location; and the apparatus further comprises:

a system controller responsive to the signals from the detectors and programmed to provide an indication of an actual thermal gradient across the diameter that intersects each of the spaced sections, the system controller being programmed to compare the actual thermal gradient to a desired thermal gradient across the across the diameter that intersects each of the spaced sections; and a thermal energy controller responsive to the system controller for controlling a supply of thermal energy to each separate spaced section of the thermal energy transfer unit to render the actual thermal gradient equal to the desired thermal gradient across the spaced sections along the diameter.

4. Apparatus for controlling local planarization properties on a wafer during the performance of a chemical mechanical polishing operation on the wafer, the apparatus comprising:

a wafer carrier;

a thermal energy transfer unit on the wafer carrier for transferring energy relative to the wafer, the thermal energy transfer unit having a plurality of separate thermal energy transfer sections, each of the separate sections being spaced along and intersecting a common diameter of the wafer; and a thermal energy detector system adjacent to the wafer for separately detecting a temperature of each location on the wafer at which the common diameter intersects the separate sections of the thermal energy transfer unit.

5. Apparatus as recited in claim 4, further comprising:

a controller responsive to the detector system separately detecting a temperature of each of the locations for controlling the transfer of thermal energy relative to the sections of the thermal energy transfer unit spaced along the common diameter to control a thermal gradient along the diameter.

6. Apparatus for controlling the temperature of a wafer for chemical mechanical polishing operations, the apparatus comprising:

a wafer carrier having a wafer mounting surface;

a thermal energy transfer unit adjacent to the wafer mounting surface for transferring energy relative to the wafer, the thermal energy transfer unit being configured with separate sections, each of the sections being configured to transfer the thermal energy to a different part of a wafer surface that is along a given diameter of the wafer, each of the sections being intersected by the given diameter, the sections collectively establishing a thermal gradient across the diameter of the wafer;

a thermal energy detector unit adjacent to the wafer mounting surface, the thermal energy detector comprising separate detectors along the given diameter and adjacent to each of the intersections of the given diameter and the separate sections of the thermal energy transfer unit for detecting the temperatures of the thermal gradient established by the separate sections; and a controller responsive to the separate detectors of the detector unit for controlling the transfer of thermal energy relative to the separate sections of the thermal energy transfer unit to control the temperatures of the thermal gradient.

7. An apparatus as recited in claim 6, wherein the thermal energy transfer unit is configured adjacent to a center of the wafer, and the thermal energy detector unit is configured to detect the temperatures of the thermal gradient along an arcuate path around the center of the wafer.

8. An apparatus as recited in claim 6, wherein:

the configuration of the thermal energy transfer unit is circular and the thermal energy transfer unit is located adjacent to an outer edge of the wafer; and the thermal energy detector unit is defined by a plurality of detectors positioned in first and second circular arrays.

9. An apparatus as recited in claim 8, wherein:

the first circular array corresponds to the circular configuration of the thermal energy transfer unit and the second circular array is adjacent to a center of the wafer.

10. An apparatus as recited in claim 8, wherein:

the controller responds to the detector unit indicating a low temperature at an area of the surface of the wafer by connecting a source of thermal energy to the thermal energy transfer unit to raise the temperature of the area.

11. An apparatus as recited in claim 8, wherein:

the controller responds to the detector unit indicating a high temperature at an area of the surface of the wafer by connecting a receiver of thermal energy to the thermal energy transfer unit to reduce the temperature of the area.

12. An apparatus as recited in claim 9, wherein:

the thermal energy transfer unit is configured to transfer the thermal energy relative to a plurality of parts of the surface of the wafer to establish a uniform thermal condition across the surface, the plurality of areas intersecting the given diameter of the wafer; and the thermal energy detector unit is configured to detect the temperature of the plurality of parts of the surface across the diameter of the wafer.

* * * * *